US009586414B2

(12) United States Patent
Kuiper et al.

(10) Patent No.: US 9,586,414 B2
(45) Date of Patent: Mar. 7, 2017

(54) METHOD FOR APPLYING AN IMAGE USING A UV CURABLE PHASE CHANGE INK

(71) Applicant: OCE-TECHNOLOGIES B.V., Venlo (NL)

(72) Inventors: Paul Kuiper, Helmond (NL); Hassan Nnafie, Eindhoven (NL)

(73) Assignee: OCE-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 15/054,322

(22) Filed: Feb. 26, 2016

(65) Prior Publication Data

US 2016/0176202 A1 Jun. 23, 2016

Related U.S. Application Data

(63) Continuation of application No. PCT/EP2014/067659, filed on Aug. 19, 2014.

(30) Foreign Application Priority Data

Aug. 27, 2013 (EP) ..... 13181796

(51) Int. Cl.
*B41J 11/00* (2006.01)
*B41M 7/00* (2006.01)

(52) U.S. Cl.
CPC ..... *B41J 11/002* (2013.01); *B41M 7/0081* (2013.01)

(58) Field of Classification Search
CPC ..... B41J 11/002; B41M 7/0081
See application file for complete search history.

(56) References Cited

U.S. PATENT DOCUMENTS

2008/0174648 A1* 7/2008 Nakano ..... B41J 11/002 347/102
2012/0062666 A1* 3/2012 Roof ..... B41M 7/0081 347/102
2012/0274716 A1* 11/2012 McConville ..... B41M 5/38207 347/102

FOREIGN PATENT DOCUMENTS

EP 2 161 137 A1 3/2010
EP 2 161 312 A1 3/2010
EP 2 161 315 A1 3/2010

* cited by examiner

*Primary Examiner* — Alessandro Amari
*Assistant Examiner* — Roger W Pisha, II
(74) *Attorney, Agent, or Firm* — Birch, Stewart, Kolasch & Birch, LLP

(57) ABSTRACT

A method for applying an image onto a receiving medium uses an ultraviolet curable phase change ink. The method includes the steps of pre-curing the ultraviolet curable ink and post-curing the ultraviolet curable ink. An ink jet apparatus is configured to perform the above mentioned method.

9 Claims, 4 Drawing Sheets

METHOD FOR APPLYING AN IMAGE USING A UV CURABLE PHASE CHANGE INK

CROSS-REFERENCE TO RELATED APPLICATIONS

This application is a Continuation of International Application No. PCT/EP2014/067659, filed on Aug. 19, 2014, and for which priority is claimed under 35 U.S.C. §120. PCT/EP2014/067659 claims priority under 35 U.S.C. §119(a) to Application No. 13181796.7, filed in Europe on Aug. 27, 2013. The entire contents of each of the above-identified applications are hereby incorporated by reference into the present application.

BACKGROUND OF THE PRESENT INVENTION

1. Field of the Invention

The present invention relates to a method for applying an image using a UV curable phase change ink and an ink jet printer suitable for performing such a method. In particular, the present invention relates to a method for applying an image comprising two curing steps, i.e. a pre-cure step and a post-cure step, wherein the two curing steps are performed using a first beam of UV radiation and a second beam of UV radiation, respectively.

2. Description of Background Art

Methods for applying an image onto a recording medium using a UV curable ink are known in the art. Generally, such methods comprise the step of applying the UV curable ink onto a recording medium, e.g. by jetting droplets of the ink using an ink jet printer.

After the ink has been applied onto the receiving medium, the ink is hardened by irradiating the ink with a suitable source of radiation, preferably UV radiation. It is known in the art that, when the layer of UV curable ink applied onto the receiving medium is relatively thick, it may not be possible to suitably cure the UV curable ink in one step. For example, the part of the ink layer close to the receiving medium may not completely cure. This problem may be addressed by curing the ink in a two-step procedure, as is explained for example in U.S. Application Publication No. 2008/0174648. Hence, it is known that applying UV radiation to a UV curable ink is required to suitably cure the ink.

However, irradiating a layer of ink applied onto a receiving medium using one or more sources of radiation may cause unwanted side-effects, for example in the case where UV curable phase change inks are used in the printing process. UV curable phase change inks may be fluid at elevated temperature and may be solid or semi-solid at lower temperatures. This type of ink may be jetted as a fluid at elevated temperate and may cool down after it has been applied onto the receiving medium, thereby transforming into a solid or semi-solid. When the temperature of UV curable phase change ink applied onto the receiving medium increases too much, the ink on the receiving medium may (partially) fluidize. This may cause print artifacts. For example, the gloss level of the resulting print after curing may be negatively influenced. In addition, coalescence of the ink may occur if the ink fluidizes before it is sufficiently cured. Hence, it may be difficult to cure a layer of UV curable phase change ink such that the ink is completely cured without obtaining print artifacts.

Therefore a need exists for applying an image using an UV curable phase change ink that mitigates the above mentioned problems.

SUMMARY OF THE PRESENT INVENTION

It is therefore an object of the present invention to provide such a method. It is another object of the present invention to provide an ink jet printer suitable for performing such a method. The object is achieved in a method for applying an image onto a receiving medium, the method comprising the steps of:

a) jetting droplets of an ultraviolet curable phase change ink from an ink jet print head at elevated temperature onto a receiving medium, wherein the elevated temperature is a temperature above a phase transition temperature T1, the phase transition temperature T1 being the temperature below which the ink is in an immobilized state;

b) allowing the deposited droplets of ink to cool to a temperature below the phase transition temperature T1, the droplets of ink thereby changing from the liquid state into the immobilized state;

c) pre-curing the deposited droplets of ink by irradiating the droplets of ink with a first beam of UV radiation, the first beam having a first intensity; and d) post-curing the deposited ink by irradiating the droplets of ink with a second beam of UV radiation, the second beam having a second intensity;

wherein:

pre-curing is done before post-curing; and the intensity of the first beam is controlled such that at least in the pre-curing step, the temperature of the ink does not exceed the phase transition temperature T1.

In the method according to the present invention, in step a) droplets of an ultraviolet (UV) curable phase change ink are applied onto a receiving medium. For example, the droplets may be applied onto the receiving medium by jetting the droplets of the ink using an ink jet apparatus. The ink jet apparatus may comprise a print head. The print head may comprise an orifice, through which droplets of the UV curable phase change ink are applied. The print head may further comprise a pressure chamber comprising a quantity of the ink. The print head may further comprise an actuator configured to generate a pressure in the fluid in the pressure chamber. Due to the pressure generated in the pressure chamber, a droplet of ink may be ejected. The ink jet may further comprise an ink reservoir.

The ink that is used in the method according to the present invention is a phase change ink. A phase change ink is an ink that is liquid at an elevated temperature and is in an immobilized state at a lower temperature. For example, the phase change ink may be in the liquid phase at a temperature above the phase change temperature T1. T1 may be e.g. 40° C.; 60° C.; 75° C. or 95° C. At lower temperatures, such as temperatures below the phase transition temperature T1, the phase change ink may be in a phase different than the liquid phase, i.e. an immobilized state. In the liquid phase, also referred to as a fluid state, the ink composition is able to flow. For example, the ink in the fluid state may be jetted using an ink jet print head. In addition, when a droplet of ink in the liquid state is applied onto a recording medium, the ink may flow over the surface of the recording medium. In this way, the droplet of ink may spread.

In the method according to the present invention, in step b), the deposited droplets of ink are allowed to cool to a temperature below the phase transition temperature T1, the droplets of ink thereby changing from the liquid state into the immobilized state. Below the phase transition temperature T1, the ink may be in an immobilized state. The immobilized state may be a state where the ink cannot flow. In the immobilized state, the position and shape of the droplet may be substantially fixed. As a consequence, the droplet may not spread over the surface. Examples of an immobilized state are the solid phase and the semi-solid phase. An example of a semi-solid phase is a gelled phase. In the ink reservoir and in the pressure chamber, the ink may be in the fluid state and therefore may be at a temperature of at least the phase transition temperature T1. To bring the ink at a temperature of at least the phase transition temperature T1 and to maintain the desired temperature, the ink jet apparatus may be provided with a heating mechanism to heat the ink. For example, the ink reservoir may be provided with heating mechanism to heat the phase change ink. Alternatively or additionally, the pressure chamber may be provided with heating mechanism for heating the pressure chamber and the ink inside the pressure chamber.

The ink in accordance with the present invention is a UV curable ink. UV curable inks are known in the art. UV curable inks are inks that comprise at least one UV curable component. The UV curable component may be curable upon irradiation of the ink by UV radiation. Curing of the ink is also known in the art as hardening of the ink. UV curable components may be, e.g. UV curable monomers and/or oligomers. Non-limiting examples of UV curable monomers are acrylate monomers, methacrylate monomers and epoxy monomers. The monomers may be monofunctional monomers (i.e. monomers comprising one radiation curable moiety), or the monomers may be multifunctional monomers (i.e. monomers comprising two or more radiation curable moieties).

The UV curable ink composition may additionally comprise at least one photo-initiator for initiating curing (e.g. initiating a polymerization reaction) upon curing of the ink composition. The UV curable ink composition may additionally comprise at least one inhibitor for preventing polymerization of the curable components of the ink, thereby increasing the shelf life of the ink.

The UV curable ink composition may further comprise a colorant. The colorant may be a pigment, a mixture of pigments, a dye, a mixture of dyes, a mixture of a dye and a pigment or a mixture of more than one dye and more than one pigment. Pigments are preferred, because of their superior color fastness with respect to dyes.

The UV curable phase change ink composition may comprise at least one component that provides the ink composition with phase change properties. For example, the ink composition may comprise a component that solidifies at a temperature lower than the phase transition temperature T1. For example, the ink may comprise a meltable wax. The meltable wax may be a liquid at a temperature above the phase transition temperature T1 and may solidify at the phase transition temperature T1. The meltable wax may be a reactive wax, such as a radiation curable wax, or may be a non-reactive wax. A radiation curable wax may be a wax that comprises a functional chemical group that is capable of undergoing a polymerization reaction upon exposure to radiation. The radiation curable wax may comprise, for example an acrylate functional group or a methacrylate functional group.

Incorporating a component that may solidify may result in the formation of a solidifiable ink, i.e. a hot melt ink. A hot melt ink is an example of a phase change ink. When a droplet of ink solidifies, the droplet of ink gets into the immobilized state and hence, the droplet may no longer flow and therefore, spread of a droplet and inter-droplet smearing may be prevented.

Additionally or alternatively, the ink composition may comprise a gelling agent. An ink comprising a gelling agent may be in the liquid phase above a gelling temperature of the gelling agent and may be in the gelled state below the gelling temperature of the gelling agent. The gelling temperature of the gelling agent may be the phase transition temperature T1. The gelled phase is a phase where a gel exists as a dynamic equilibrium between a solid gellant and a fluid. The gel phase is a dynamic networked assembly of molecular components held together by non-covalent interactions. Upon formation of the gelled phase, the viscosity of the ink composition may increase. A higher viscosity prevents flow of the droplet and may thereby immobilize the droplet. Thus, also gelling of a droplet of ink may prevent spread of a droplet and inter-droplet smearing.

Thus both gelling and solidification are suitable phase changes to immobilize the ink and to prevent spread of a droplet and inter-droplet smearing and both phase changes may be suitably applied in an ink such as a radiation curable ink. In general, any phase change that diminishes the flowability of a droplet of ink upon cooling of the ink may be suitably applied.

The phase change property of the radiation curable ink may allow stabilizing the droplets applied onto the receiving medium before they are cured. E.g. when a phase change radiation curable ink is used for applying an image onto a receiving medium, it may not be necessary to cure immediately after the droplet has landed onto the receiving medium; there may be a time interval in between application of the droplets onto the receiving medium and curing, without droplet smearing occurring.

The radiation curable ink may be cured by irradiating the ink. The ink may be irradiated with suitable radiation, for example UV radiation. The radiation may induce a chemical reaction in the ink composition. For example, the radiation may initiate a polymerization reaction in the ink, which results in hardening of the ink composition, thereby fixing the ink composition.

In the method according to the present invention, curing of the ink is performed in at least two steps. In the method, in step c), the deposited droplets of ink are pre-cured by irradiating the droplets of ink with a first beam of UV radiation, the first beam having a first intensity. In the pre-curing step, the radiation, such as the UV radiation, may be provided by a suitable radiation source, such as a lamp, e.g. a UV lamp. The source of UV radiation may produce a first beam of UV radiation. This first beam may have a first intensity. The intensity of the beam may refer to the irradiance; i.e. the total amount of radiation locally received onto the receiving medium per unit area.

In the method, in step d), the deposited ink is post-cured by irradiating the droplets of ink with a second beam of UV radiation, the second beam having a second intensity. In the post-curing step, the radiation, such as the UV radiation, may be provided by a suitable radiation source, such as a lamp, e.g. a UV lamp. The source of UV radiation may produce a second beam of UV radiation. This second beam may have a second intensity. The intensity of the beam refers to the amount of energy applied by the beam to the receiving medium per unit area.

By performing the pre-curing and the post-curing, the image applied onto the receiving medium may be suitably cured. After the radiation curable phase change ink has been cured, a network has been formed within the ink and the radiation curable ink is then no longer fluid. After curing, the ink composition may no longer become fluid at the phase transition temperature T1. Furthermore, by fixing the ink composition, the ink layer has become firmly attached to the receiving medium and is not easily removed anymore from the receiving medium. The cured image may have a gloss appearance after curing, a matt gloss appearance or a semi-gloss appearance.

In the method according to the present invention, pre-curing is done before post-curing. Hence, after the ink has been applied onto the recording medium, the ink is first pre-cured and afterwards, post-cured.

In the method according to the present invention, the intensity of the first beam is controlled such that at least in the pre-curing step, the temperature of the ink does not exceed the phase transition temperature T1. The first beam of UV radiation may comprise UV radiation of a plurality of wavelengths. The total amount of radiation may result in heating of the ink, when the ink is irradiated by the first beam. When the ink is heated, the temperature of the ink may rise. Depending e.g. on the amount of heat supplied to the ink by the first beam of radiation, the temperature of the ink may rise to a temperature above the phase change temperature T1. In the pre-curing step, the ink may be at most partially cured. Network formation between the polymerizable components present in the ink is not yet finished and unreacted polymerizable compound may still be present. Therefore, if in the pre-curing step the temperature of the ink rises to a temperature above the phase transition temperature T1, then (part of) the ink may undergo a phase change and return to the fluid state. Such phase change may influence the gloss of the image. Therefore, the intensity of the first beam is controlled such that, at least in the pre-curing step, the temperature of the ink does not exceed the phase transition temperature T1. The person skilled in the art will understand how the intensity of the beam can be suitably controlled. For example, the amount of radiation emitted by a source of radiation may be controlled. Alternatively, the type of source may be suitably selected. Alternatively or additionally, the distance between the ink deposited on the recording medium and the source of radiation may be suitably selected. Furthermore, a suitable filter may be applied to reduce the intensity of the radiation emitted by a source with a predetermined factor.

When the ink is cured in the post-cure step, the ink may be completely cured. When the ink has been completely cured, i.e. when essentially all polymerizable compound has been polymerized and the ink layer has hardened, heating of the ink layer may not result in a partial phase change anymore. Thus, the second intensity, i.e. the intensity of the second beam used in the post-curing step, may be higher than the first intensity of the first beam.

In an embodiment, the first beam has a first main wavelength and the second beam has a second main wavelength. The first beam of radiation, emitted by the first source of radiation, may emit a first spectrum of radiation, the spectrum having a certain width. The first spectrum may have a maximum; i.e. a wavelength which is present in the beam at higher intensity than other wavelengths. This maximum will be referred to as the first main wavelength. Because the first main wavelength is emitted at a higher intensity compared to other wavelengths present in the spectrum of the radiation of the first beam, the first main wavelength may have the strongest influence on the curing process, compared to the other wavelengths. The first main wavelength may be in the UV range, for example in the UV-A range (410 nm-315 nm), the UV-B range (315 nm-280 nm) or the UV-C range (280 nm-100 nm). The second beam of radiation, emitted by the second source of radiation, may emit a second spectrum of radiation, the spectrum having a certain width. The second spectrum may have a maximum; i.e. a wavelength which is present in the beam at higher intensity than other wavelengths. This maximum will be referred to as the second main wavelength. Because the second main wavelength is emitted at a higher intensity compared to other wavelengths present in the spectrum of the radiation of the second beam, the second main wavelength may influence the curing process most, compared to the other wavelengths emitted by the second source of radiation. The second main wavelength may be in the UV range, for example in the UV-A range (410 nm-315 nm), the UV-B range (315 nm-280 nm) or the UV-C range (280 nm-100 nm).

Further, in the embodiment, the first main wavelength is different from the second main wavelength. The radiation of the first beam may have a main wavelength different from the main wavelength of the second beam of UV radiation. The ink composition may comprise a number of components, some of which may be able to absorb UV radiation, such as radiation of the first main wavelength and/or radiation of the second main wavelength. When UV radiation is absorbed by UV curable monomers or oligomers, or by photoinitiators present in the ink composition, this may result in polymerization of the curable polymers and/or oligomers and may result in curing of the ink. However, other components in the ink, for example pigments, may also absorb UV radiation. UV absorption by pigments may not result in curing of the ink. If there are components, e.g. pigments, present in the ink composition that absorbs the UV radiation emitted by the first beam of radiation, then curing may be slower at the part of the ink layer close to the receiving medium (lower part of the ink layer) and faster at the upper part of the ink layer. Hence, the ink layer may not be properly cured. Therefore, in the method according to the present invention, a pre-curing step is performed using a first beam of UV radiation. The first main wavelength may penetrate deep into the layer of ink and may cure also the inside of the ink layer. The first curing step may induce gentle curing of the ink layer. In other words, part of the polymerizable moieties in the ink may become polymerized during the pre-curing step. However, the ink layer may not become completely cured during the pre-curing step. The partial curing may further immobilize the ink. After the pre-curing step, the ink is cured in a post-curing step, using UV light having a second wavelength, the second wavelength being different from the first wavelength. This second UV radiation may not penetrate through the ink layer and may only cure an upper part of the ink layer. However, the second curing step may induce faster curing than the first curing step. In addition, the upper part of the layer may be in contact with oxygen in the air. The presence of oxygen may hamper the curing process and hence, post-curing may provide additional radiation to at least the upper layer of the print to properly cure said upper layer.

The first main wavelength and the second main wavelength may be suitably selected, e.g. based on the absorption spectra of the photo-initiator, the polymerizable compound (s) and other components present in the ink, such as pigments.

By applying the pre-curing as well as the post-curing step, the ink layer may become efficiently cured and hence, the thick layer of ink may be cured in a two-step curing process.

In a further embodiment, the first main wavelength is larger than the second main wavelength. Radiation having a larger wavelength may be less efficiently absorbed by components in the ink that do not polymerize upon curing, such as pigments. Hence, a larger wavelength may penetrate deeper into the ink layer and may therefore be suitably applied to pre-cure the layer of ink.

In an embodiment, the ink comprises a gellant. The radiation curable gelling ink composition may be a fluid at a temperature above the phase transition temperature T1. At or below the phase transition temperature T1, the gelling agent may form a gel and by forming the gel, the gelling agent may gel the ink. The ink may then be in a so-called gelled phase. Hence, the gelling agent may provide the ink with a phase change upon cooling the ink composition to a temperature below the phase transition temperature T1.

As explained above, the gelled phase may be considered a phase wherein a dynamic equilibrium exists between a solid gellant and a fluid. The gel phase is a dynamic networked assembly of molecular components held together by non-covalent interactions. The networked assembly of molecular components may be formed by the gelling agent. The fluid that is present in the networked assembly formed by the gelling agent may comprise the radiation curable component. In addition, the fluid may comprise additional ink components, such as a photoinitiator, an inhibitor and/or a colorant. Thus, when the droplet is transformed from a fluid into a gel and consequently, spreading of the droplet is prevented, the radiation curable component may still be in the fluid phase. Without wanting to be bound to any theory, it is believed that curing of the ink, which may be achieved by inducing a polymerization reaction to polymerize the radiation curable components, may occur faster if the radiation curable component is in the fluid state compared to the situation where the radiation curable component is in the solid state.

The gelling agent may be suitably selected. The gelling agent may be a component capable of forming a (supra) molecular network.

A number of non-limiting examples of the gelling agent are: ketones such as laurone, stearone, di-n-dodecylketone, pyristone, 15-nonacosanone, behenone, palmitone, di-n-hexadecylketone; oligo-ester compounds, the oligo-ester compounds being the reaction product of a poly-hydroxy component, such as pentaerythritol or glycerol and an carboxylic acid comprising an alkyl chain, such as stearic acid—, palmitic acid, arachidic acid, linoleic acid or myristic acid esters; a long chain terminal alcohol, such as a C10-C40 long chain terminal alcohol, for example a C15-C30 long chain terminal alcohol, such as a C20-C25 long chain terminal alcohol. Examples of commercially available long chain terminal alcohols are Unilin® waxes, available from Baker Hughes Inc. Further non-limiting examples of gelling agents are long chain terminal carboxylic acid waxes, such as the Unicid® waxes commercially available from Baker Hughes Inc.; urethane waxes, such as ADS043 or ADS039 commercially available from American Dye Source Inc. of Baie D' Urfe, Quebec, Canada; waxes occurring in nature, such as candelilla wax, cerilla wax or montan wax; alkyl-ester waxes, such as the Kester Wax K-AE-80, commercially available from Koster Keunen; amide waxes, such as a primary amide wax or a secondary amide wax, for example octadecane amide wax, stearylstrearate or Erucamide; or a reactive wax. Non-limiting examples of reactive waxes are acrylate waxes, such as acrylated alkyl waxes, vinylether waxes, and alkene waxes, such as oleyl arachidate. Examples of commercially available reactive waxes are reactive Licomont® waxes and reactive Ceridust® waxes, obtainable from Clariant International Ltd.

In an embodiment, the ink comprises a crystalline component and the phase transition temperature T1 is the melting temperature of the crystalline component.

When the ink is ejected, the ink is in a fluid state and hence, the temperature of the ink may be at a temperature above the phase transition temperature T1. At such temperature, a crystalline component having a melting temperature of the phase transition temperature T1 may be in the fluid state. When the ink is ejected onto a recording medium, the droplets of ink may cool down to a temperature below the phase transition temperature T1. Upon cooling down, the crystalline component may solidify and crystallize. The speed of crystallization may be influenced by the speed of cooling of the ink, which may be controlled, e.g. by controlling the temperature of the medium. When the crystalline component present in the ink composition crystallizes, crystals are formed. Crystals may influence the gloss of an image applied onto the receiving medium.

During the pre-curing step, the layer of ink may be at most partially cured. Both the part of the ink layer close to the receiving medium as well as the upper part of the ink layer (i.e. the part of the ink layer distant from the receiving medium) may be at most partially cured. When the ink layer is at most partially cured, network formation between the curable components of the ink is not yet completed. During the pre-curing step, the ink is partially cured by irradiating the ink using a first beam of radiation. This beam has a first intensity and hence, due to the radiation of the first beam, the ink may heat. In the pre-curing step, the intensity of the first beam is controlled such that the temperature of the ink does not exceed the phase transition temperature T1. As a consequence, the crystalline component having a melting temperature of the phase transition temperature T1 may not melt and may stay in the crystalline form. Without wanting to be bound to any theory, it is believed that melting of the crystalline material in an ink layer that is not yet completely cured may irreversible alter the gloss characteristic of the print. Hence, by controlling the intensity of the first beam such that the temperature of the ink does not exceed the phase transition temperature T1, the gloss characteristics of the print may be preserved.

In the post-curing step, the ink layer may be cured further. Hence, the ink may be cured to such an extent that a robust layer, comprising a network of cured ink components, is formed. Post-curing may be performed by irradiating the ink using the second beam of radiation, the second beam having a second intensity. Without wanting to be bound to any theory, it is believed that when a robust layer has been formed, the mobility of the ink components within the ink layer is very low. When the temperature of the cured layer exceeds the phase transition temperature T1, this may have no or little influence on the gloss of the print.

Optionally, the crystalline component may be a gellant. When the gellant is a crystalline component, the gellant can provide phase-change characteristics to the ink and can influence the gloss of the print. Alternatively, the crystalline component may be another component of the ink composition, e.g. a binder.

Non-limiting examples of crystalline gelling agents are ketones such as laurone, stearone, di-n-dodecylketone, pyristone, 15-nonacosanone, palmitone, di-n-hexadecylketone; long chain terminal alcohols, such as a C10-C40 long chain terminal alcohol, for example a C15-C30 long chain terminal alcohol, such as a C20-C25 long chain terminal alcohol; or urethane waxes or vinylether waxes, such as the commercially available Vectomer® monomers, obtainable from Sigma-Aldrich.

Optionally, two or more crystalline gelling agents may be used in an ink composition. Optionally, in an ink set comprising a plurality of in compositions, such as an ink set comprising Cyan, Magenta, Yellow and black ink, the type and amount of crystalline gelling agent comprised in each of the respective ink compositions within an ink set may be varied.

In an embodiment, in step a), the print head moves in reciprocation in a main scanning direction, the main scanning direction being substantially perpendicular to a direction of paper transport.

During scanning, the print head ejecting the droplets and the receiving medium may move relative to each other in a main scanning direction. This may be done by moving a print head mounted on a carriage over the receiving medium in the main scanning direction when applying droplets of ink to the receiving medium.

In a current swath, the carriage carrying the print head and the receiving medium may move relative to one another and a pattern of droplets may be printed onto the receiving medium, thereby forming (part of) an image. After the current swath has been completed, the carriage and the receiving medium may be moved relative to each other in a paper transport direction, also known as sub scanning direction. The relative movement of the carriage and the receiving medium with respect to each other in between swaths is known as a paper step. The receiving medium may be moved such that a part of the receiving medium not yet provided with the image is positioned such that the print head may jet droplets of ink onto that part of the receiving medium when the carriage moves in the main scanning direction. Preferably, the movement in the sub scanning direction is such that the paper step is not visible in the printed image.

After the paper step has been performed, the carriage and the receiving medium may move again with respect to one another in the main scanning direction in a subsequent swath.

In a further embodiment, in step c) the first beam of UV radiation is provided by a first source of UV radiation and in step d) the second beam of UV radiation is provided by a second source of UV radiation and wherein the first source of UV radiation and the second source of UV radiation are both moved in the main scanning direction in a synchronous way.

The print head(s) as well as the sources of UV radiation may be moved in reciprocation in the main scanning direction. The print head(s) may be positioned at a distance in the paper transport direction with respect to the sources of UV radiation. In the context of the present invention, the synchronous movement of the print head and the sources of UV radiation means that the print head and the sources of UV radiation start and stop movement in the main scanning direction at the same time. The speed of movement in the main scanning direction of the print head and the sources of UV radiation may preferably be the same. Preferably, the width of the swath printed by the print head corresponds to the width of the image irradiated by the first source of UV radiation.

The print head and the sources of UV radiation may move synchronously in the same direction. Alternatively, the print head and the sources of UV radiation may move synchronously in opposite directions. By moving the print head and the sources of UV radiation in a synchronous way, the time between ejection of the ink onto the receiving medium and curing of the ink may be constant. As a consequence, the extent to which the ink has cooled down may be constant. Hence, the properties of the ink droplets may be constant and the visual appearance of the ink after curing may be constant.

If the ink comprises a crystalline component having a melting temperature of the phase transition temperature T1, the extent to which the crystalline component has formed crystals may be constant. This may prevent inhomogeneous gloss throughout the printed image after curing.

In an aspect of the invention, an ink jet printer for applying an image onto a receiving medium is provided, the ink jet printer comprising:

- an ink jet print head configured to jet droplets of an ultraviolet curable phase change ink;
- a first source of UV radiation, adapted to in operation provide a first beam of UV radiation;
- a second source of UV radiation, adapted to in operation provide a second beam of UV radiation; and
- transport mechanism configured to move a recording medium relative to the ink jet print head and the first and second sources of UV radiation in a paper transport direction,
- wherein the second source of UV radiation is positioned downstream with regard to the ink jet print head and the first source of UV radiation.

The ink jet apparatus according to the present invention is thus configured for performing the method according to the present invention.

The first source of UV radiation may be a lamp, such as a mercury lamp, xenon lamp, carbon arc lamp, tungsten filaments lamp, light emitting diode (LED's) and laser. The first source of UV radiation may emit a first beam having a first intensity. The intensity of the beam may be controlled by controlling the amount of energy supplied to the first source of UV radiation, by selecting a suitable source of radiation, by providing the first source of radiation with a filter reducing the intensity of the first beam to a pre-defined intensity. In addition, the intensity of the beam irradiating the ink applied onto the receiving medium may be suitable controlled by controlling the distance between the receiving medium and the source of radiation. In an embodiment, the first source may emit a first spectrum having a first main wavelength.

The second source of radiation may be a lamp such as a mercury lamp, xenon lamp, carbon arc lamp, tungsten filaments lamp, light emitting diode (LED's) and laser. The second source of UV radiation may emit a second beam having a second intensity. The intensity of the beam may be controlled as explained with respect to the first source of UV radiation. In an embodiment, the second source may emit a second spectrum having a second main wavelength.

The first beam of radiation and the second beam of radiation may be provided by two different lamps. Alternatively, the sources of radiation may be an assembly of a lamp and a filter, wherein a lamp emits the first and the second main wavelengths, the lamp being provided with two distinct filters; one filter passing a first intensity of radiation and the second filer passing a second intensity of radiation. In an embodiment, one filter may pass a first spectrum of UV radiation having a first main wavelength and the second filter may pass a second spectrum having a second main wavelength.

Preferably, the first main wavelength and the second main wavelength may both lie within the UVA range, which comprises radiation having a wavelength in the range of from 320 nm to 410 nm.

Preferably, the first main wavelength is from 410 nm-250 nm, preferably from 408 nm-320 nm, such as from 405 nm-360 nm, for example from 400 nm-380 nm. Preferably, the second main wavelength is from 405 nm-210 nm, preferably from 403 nm-300 nm, such as from 400 nm-350 nm, for example from 395 nm-375 nm.

The first intensity may be in the range of from 0.1 W/cm2-30 W/cm2, for example from 0.3 W/cm2-20 W/cm2, such as from 0.5 W/cm2-10 W/cm2.

The second intensity may be in the range of 0.5 W/cm2-40 W/cm2, for example from 1.0 W/cm2-25 W/cm2, such as from 5 W/cm2-15 W/cm2.

The second intensity may be 1.2-10 times higher than the first intensity. Preferably, the second intensity may be 1.5-7 times higher than the first intensity. For example, the second intensity may be 2-5 times higher than the first intensity, such as 3-4 times higher than the first intensity.

In an embodiment, the ink jet printer comprises a temperature regulator configured to regulate the temperature of the receiving medium.

In step b) of the method according to the present invention, the ink deposited on the receiving medium is allowed to cool down. The rate of cooling may depend on a plurality of parameters, such as the jetting temperature of the ink, the amount of ink applied onto the receiving medium, the temperature of the surroundings and/or the temperature of the receiving medium. The temperature of the ink at the moment the ink is pre-cured may depend, e.g. on the rate of cooling of the ink in step b). The temperature of the ink applied onto the receiving medium may be suitably controlled by controlling the temperature of the receiving medium, onto which the droplets of ink are applied. The temperature of the receiving medium may be controlled by a suitable temperature regulator. The temperature regulator may be configured to cool the receiving medium and/or heat the receiving medium. Any suitable type of temperature regulator may be used. For example, an electrical heating or cooling may be used. Optionally, a cooling fluid, such as water, may be used.

Further scope of applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMEMTS

Figure 1A:
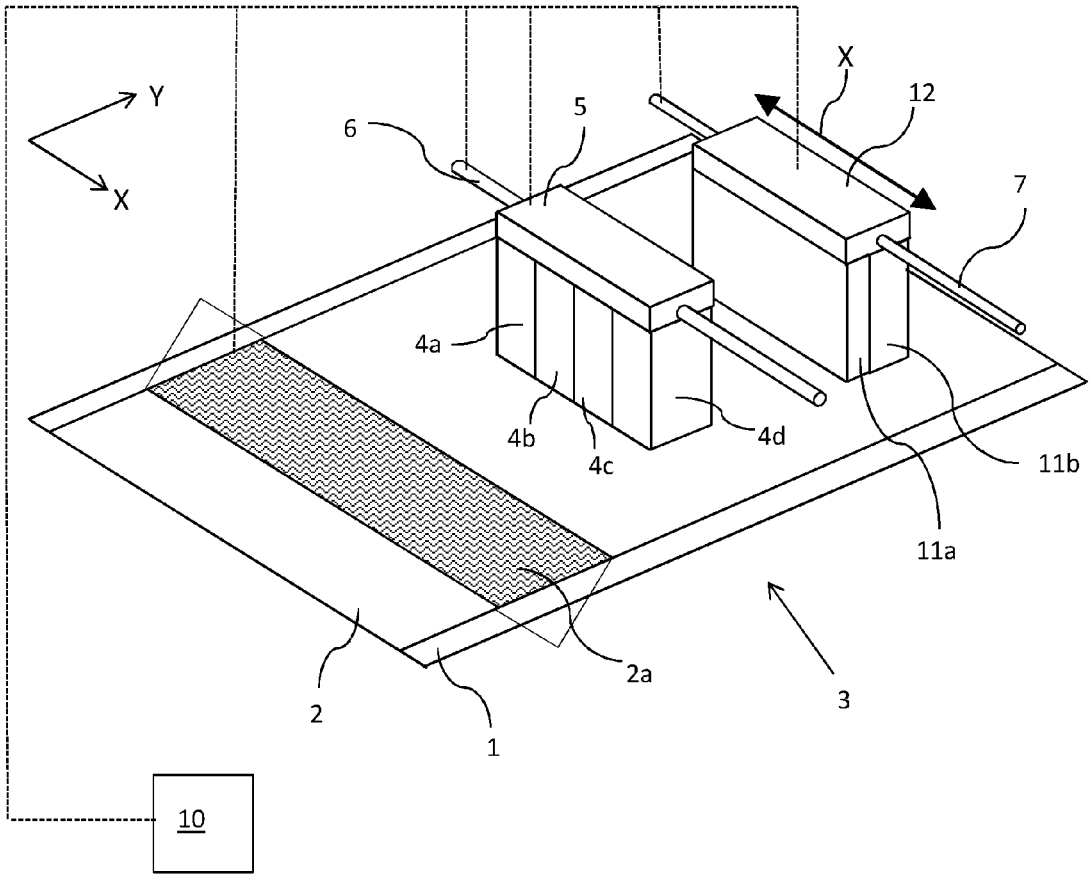
FIG. 1A is a schematic representation of an inkjet printing system.

The present invention will now be described with reference to the accompanying drawings, wherein the same reference numerals have been used to identify the same or similar elements throughout the several views.

Figure 1B:
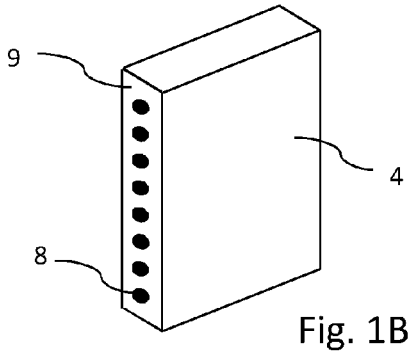
FIG. 1B is a schematic representation of an inkjet print head.

FIG. 1A shows an ink jet printing assembly 3. The ink jet printing assembly 3 comprises a support configured for supporting an image receiving medium 2. The support is shown in FIG. 1A as a flat surface 1, but alternatively, the support may be a platen, for example a rotatable drum that is rotatable around an axis. The support may be optionally provided with suction holes for holding the image receiving medium in a fixed position with respect to the support. The ink jet printing assembly 3 comprises print heads 4*a*-4*d*, mounted on a scanning print carriage 5. The scanning print carriage 5 is guided by a suitable guide 6 to move in reciprocation in the main scanning direction X. Each print head 4*a*-4*d* comprises an orifice surface 9, which orifice surface 9 is provided with at least one orifice 8, as is shown in FIG. 1B. The print heads 4*a*-4*d* are configured to eject droplets of marking material onto the image receiving medium 2.

The image receiving medium 2 may be a medium in web or in sheet form and may be composed of e.g. paper, cardboard, label stock, coated paper, plastic or textile. Alternatively, the image receiving medium 2 may also be an intermediate member, endless or not. Examples of endless members, which may be moved cyclically, are a belt or a drum. The image receiving medium 2 is moved in the sub-scanning direction Y over the flat surface 1 along four print heads 4*a*-4*d* provided with a fluid marking material.

The image receiving medium 2, as depicted in FIG. 1A is locally heated or cooled in the temperature control region 2*a*. In the temperature control region 2*a*, a temperature controller (not shown), such as a heating and/or cooling mechanism may be provided to control the temperature of the receiving medium 2. Optionally, the temperature controller may be integrated in the support for supporting an image receiving medium 2. The temperature controller may be an electrical temperature controller. The temperature controller may use a cooling and/or heating liquid to control the temperature of the image receiving medium 2. The temperature controller may further comprise a sensor (not shown) for monitoring the temperature of the image receiving medium 2.

The scanning print carriage 5 carries the four print heads 4*a*-4*d* and may be moved in reciprocation in the main scanning direction X parallel to the platen 1, such as to enable scanning of the image receiving medium 2 in the main scanning direction X. Only four print heads 4*a*-4*d* are depicted for demonstrating the invention. In practice, an arbitrary number of print heads may be employed. In any case, at least one print head 4*a*-4*d* per color of marking material is placed on the scanning print carriage 5. For example, for a black-and-white printer, at least one print head 4*a*-4*d*, usually containing black marking material is present. Alternatively, a black-and-white printer may comprise a white marking material, which is to be applied on a black image-receiving medium 2. For a full-color printer, containing multiple colors, at least one print head 4*a*-4*d* for each of the colors, usually black, cyan, magenta and yellow is present. Often, in a full-color printer, black marking material is used more frequently in comparison to differently colored marking material. Therefore, more print heads 4*a*-4*d* containing black marking material may be provided on the scanning print carriage 5 compared to print heads 4*a*-4*d* containing marking material in any of the other colors. Alternatively, the print head 4*a*-4*d* containing black marking material may be larger than any of the print heads 4*a*-4*d*, containing a differently colored marking material.

The carriage 5 is guided by the guide 6. The guide 6 may be a rod as depicted in FIG. 1A. Although only one rod 6 is depicted in FIG. 1A, a plurality of rods may be used to guide the carriage 5 carrying the print heads 4. The rod may be driven by a suitable drive (not shown). Alternatively, the carriage 5 may be guided by other guides, such as an arm being able to move the carriage 5. Another alternative is to move the image receiving material 2 in the main scanning direction X.

Each print head 4*a*-4*d* comprises an orifice surface 9 having at least one orifice 8, in fluid communication with a pressure chamber containing fluid marking material provided in the print head 4*a*-4*d*. On the orifice surface 9, a number of orifices 8 are arranged in a single linear array parallel to the sub-scanning direction Y, as is shown in FIG. 1B. Alternatively, the nozzles may be arranged in the main scanning direction X. Eight orifices 8 per print head 4*a*-4*d* are depicted in FIG. 1B, however obviously in a practical embodiment several hundreds of orifices 8 may be provided per print head 4*a*-4*d*, optionally arranged in multiple arrays.

As depicted in FIG. 1A, the respective print heads 4*a*-4*d* are placed parallel to each other. The print heads 4*a*-4*d* may be placed such that corresponding orifices 8 of the respective print heads 4*a*-4*d* are positioned in-line in the main scanning direction X. This means that a line of image dots in the main scanning direction X may be formed by selectively activating up to four orifices 8, each of them being part of a different print head 4*a*-4*d*. This parallel positioning of the print heads 4*a*-4*d* with corresponding in-line placement of the orifices 8 is advantageous to increase productivity and/or improve print quality. Alternatively, multiple print heads 4*a*-4*d* may be placed on the print carriage adjacent to each other such that the orifices 8 of the respective print heads 4*a*-4*d* are positioned in a staggered configuration instead of in-line. For instance, this may be done to increase the print resolution or to enlarge the effective print area, which may be addressed in a single scan in the main scanning direction X. The image dots are formed by ejecting droplets of marking material from the orifices 8.

The ink jet printing assembly 3 may further comprise a curing mechanism 11*a*, 11*b*. As shown in FIG. 1A, a scanning print carriage 12 carries two curing mechanisms 11*a*, 11*b* and may be moved in reciprocation in the main scanning direction X parallel to the platen 1, such as to enable scanning of the image receiving medium 2 in the main scanning direction X. Alternatively, more than two curing mechanisms may be carried by the scanning print carriage 12. It is also possible to apply a page-wide curing mechanism. If a page-wide curing mechanism is provided, then it may not be necessary to move the curing mechanism in reciprocation in the main scanning direction X. The first curing mechanism 11*a* may emit a first beam of UV radiation, the first beam having a first intensity. The first curing mechanism 11*a* may be configured to provide the radiation for the pre-curing step. The second curing mechanism 11*b* may emit a second beam of radiation, the second beam of radiation having a second intensity. The second curing mechanism 11*b* may be configured to provide the radiation for the post-curing step.

The carriage 12 is guided by a guiding 7. The guide 7 may be a rod as depicted in FIG. 1A. Although only one rod 7 is depicted in FIG. 1A, a plurality of rods may be used to guide the carriage 12 carrying the curing mechanisms 11*a* and 11*b*. The rod 7 may be driven by suitable drive (not shown). Alternatively, the carriage 12 may be guided by other guides, such as an arm being able to move the carriage 12.

The curing mechanism may be energy sources, such as actinic radiation sources, accelerated particle sources or heaters. Examples of actinic radiation sources are UV radiation sources or visible light sources. UV radiation sources are preferred, because they are particularly suited to cure UV curable inks by inducing a polymerization reaction in such inks. Examples of suitable sources of such radiation are lamps, such as mercury lamps, xenon lamps, carbon arc lamps, tungsten filaments lamps, light emitting diodes (LED's) and lasers. In the embodiment shown in FIG. 1A, the first curing mechanism 11*a* and the second curing mechanism 11*b* are positioned parallel to one another in the sub scanning direction Y. The first curing mechanism 11*a* and the second curing mechanism 11*b* may be the same type of energy source or may be a different type of energy source. For example, when the first and second curing mechanisms 11*a*, 11*b*, respectively both emit actinic radiation, the wavelength of the radiation emitted by the two respective curing mechanisms 11*a*, 11*b* may differ or may be the same. The first and second curing mechanisms are depicted as distinct devices. However, alternatively, only one source of UV radiation emitting a spectrum of radiation may be used, together with at least two distinct filters. Each filter may absorb a part of the spectrum, thereby providing two beams of radiation, each one having a different intensity from the other.

The flat surface 1, the temperature controller, the carriage 5, the print heads 4*a*-4*d*, the carriage 12 and the first and second curing mechanisms 11*a*, 11*b* are controlled by a suitable controller 10.

Figure 2:
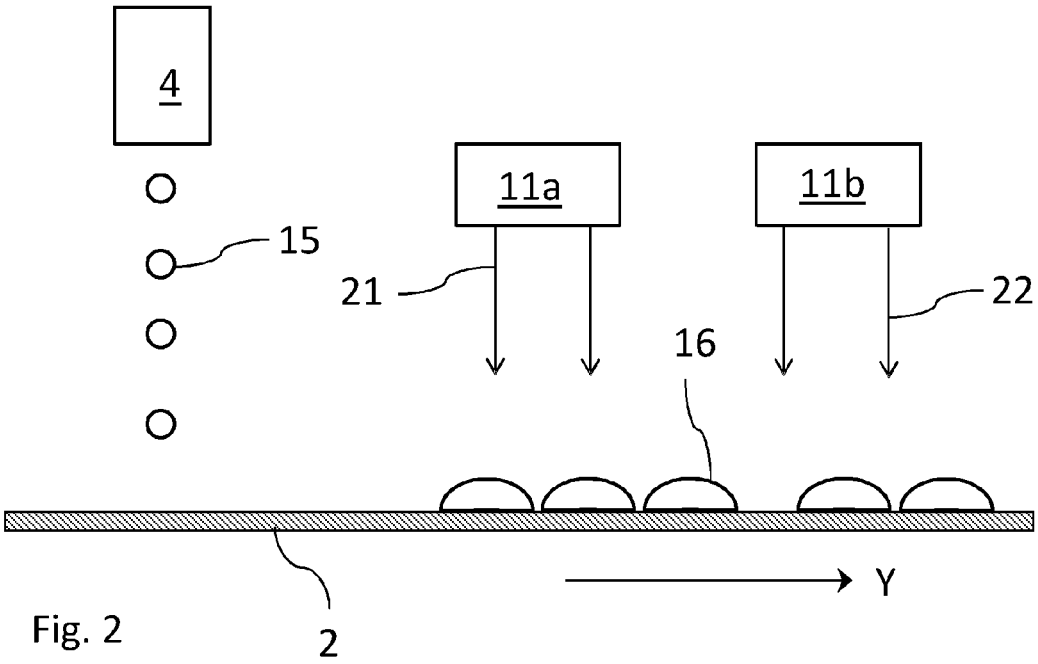
FIG. 2 schematically shows a first example of the method according to the present invention.

FIG. 2 schematically shows a first example of the method according to the present invention. A print head 4 is configured to jet droplets 15 of ink onto a receiving medium 2. Only one print head 4 is depicted in FIG. 2, but in practice, a plurality of print heads may be provided, optionally jetting different colors of ink. Each one of the droplets 15, when jetted by the print head, is in the fluid state. To bring and keep the ink in the fluid state, the print head may be provided with a heating mechanism (not shown). The ink may start cooling down after is has been ejected from the print head 4 through a nozzle (not shown). The ink may undergo a phase change, because of the cooling of the ink. The receiving medium 2 onto which droplets 15 of the ink are applied is moved in direction Y, which is the paper transport direction. In case a scanning ink jet process is used, for example the one shown in FIG. 1, the paper transport direction is often referred to as the main scanning direction. After the droplets of ink have been applied, the droplets may continue to cool down and a phase change may occur, which results in the formation of immobilized droplets 16. The immobilized droplets 16 are transported together with the receiving medium in the paper transport direction Y. Thereby, the immobilized droplets 16 are moved underneath the first source of UV radiation 11*a*. The first source of UV radiation 11*a* emits a first beam of radiation, schematically depicted as rays of radiation 21. The radiation emitted by the first source 11*a* may have a first intensity. The immobilized droplets are pre-cured by the rays 21 of the radiation emitted by the first source of radiation 11*a*. The intensity of the radiation is selected such that the temperature of the droplets 16 does not exceed T1. Therefore, the droplets stay in the immobilized state. By pre-curing the droplets, the immobilized droplets 16 are partially cured and may thereby become even more immobilized. After undergoing the post-curing, there may be a certain time interval before the droplets are post-cured. Since the droplets 16 are immobilized, this should not negatively influence the quality of the image formed.

After the immobilized droplets 16 have been pre-cured, the droplets are moved underneath a second source of UV radiation 11*b*. This second source of UV radiation 11*b* emits a second beam of radiation, schematically depicted as rays of radiation 22. The radiation emitted by the second source 11*b* may have a second intensity. The immobilized droplets are post-cured by the rays 22 of the radiation emitted by the second source of radiation 11*b*. Upon post-curing the droplets 16, the droplets may be fixed onto the receiving medium and may not change shape any more, even if they are heated to a temperature above T1.

The type of the first source of UV radiation 11*a* and the second source of UV radiation 11*b* may be suitably selected.

Figure 3:
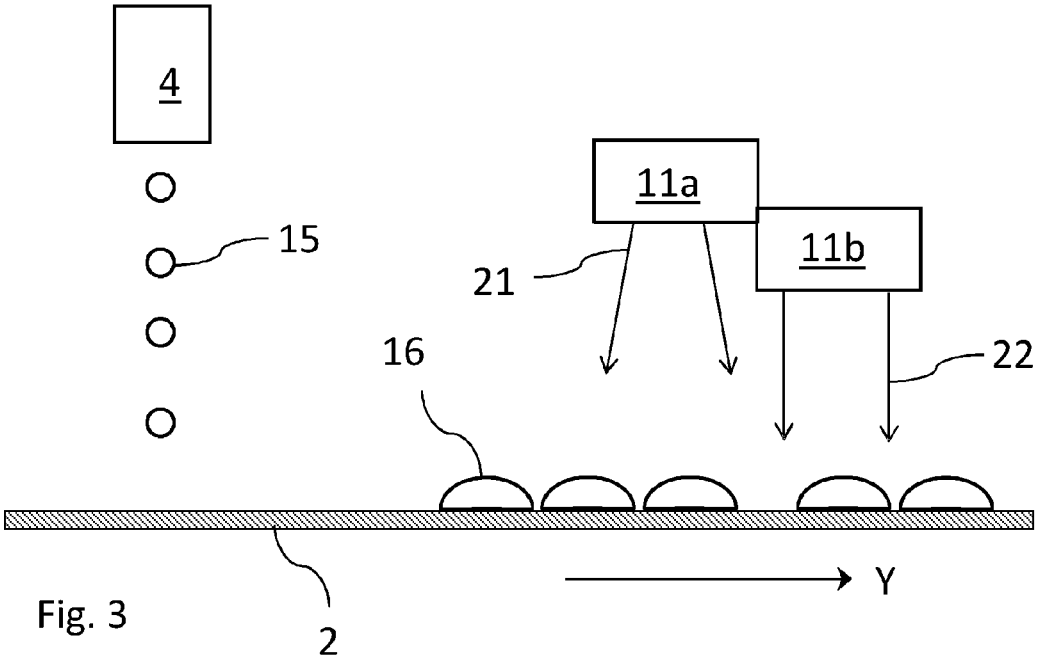
FIG. 3 schematically shows a second example of the method according to the present invention.

FIG. 3 schematically shows a second example of the method according to the present invention. The second example differs from the first example in the relative positioning of the first and second source of radiation 11*a*, 11*b*, respectively.

The distance between the first source of radiation 11*a* and the receiving medium 2 is larger than the distance between the second source of radiation 11*b* and the receiving medium 2. Like in the embodiment shown in FIG. 2, the first source of radiation 11*a* emits a first type of radiation having a first spectrum, the first spectrum having a first main wavelength. The radiation emitted by the first source of radiation 11*a* has a first intensity. The second source of radiation 11*b* emits a second type of radiation, the second type of radiation having a second spectrum, said second spectrum having a second main wavelength. The radiation emitted by the second source of radiation 11*b* has a second intensity.

The beam of radiation emitted by the first source of radiation 11*a*, schematically depicted as rays of first radiation 21, is divergent. As a consequence, the diameter of the beam emitted by the first source 11*a* increases with increasing distance from the first source 11*a*. Hence, the intensity of the beam that locally irradiates a droplet 16 decreases with increasing distance between the droplet and the source of radiation 11*a*. As a consequence, the intensity of the beam that irradiates the immobilized droplet 16 and thereby pre-cures the immobilized droplet applied onto the receiving medium 2 may be controlled by controlling the distance between the receiving medium 2 and the first source of radiation 11*a*.

Figure 4:
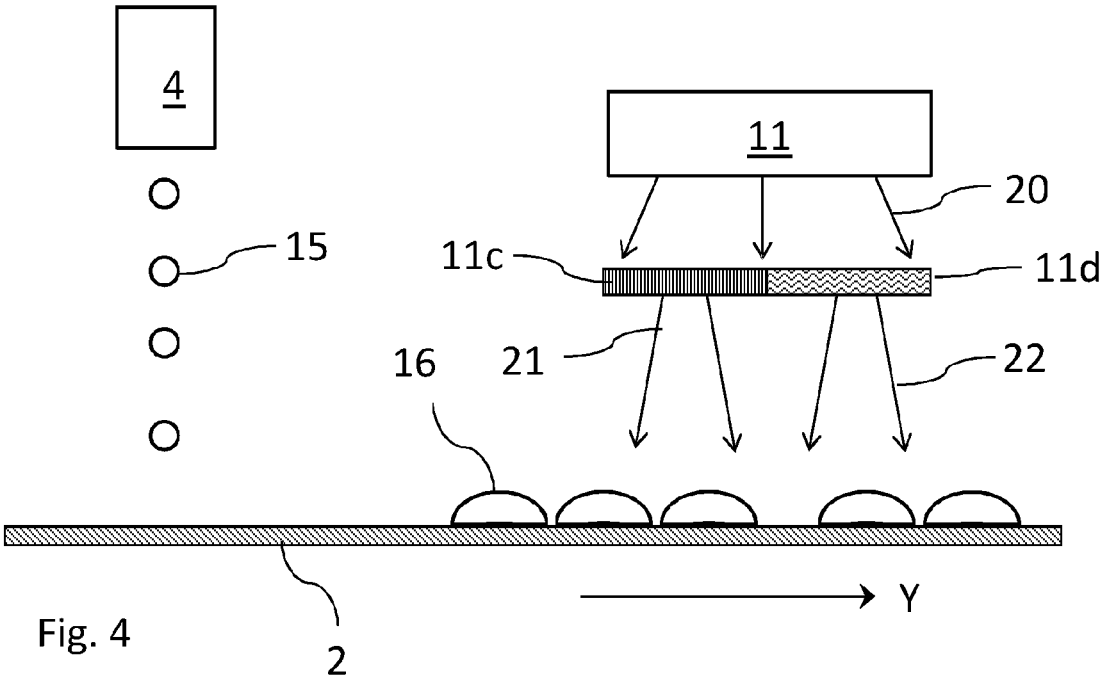
FIG. 4 schematically shows a third example of the method according to the present invention.

FIG. 4 schematically shows a third example of the method according to the present invention. The third example differs from the first and second examples in the nature of the first and second source of radiation. The source of radiation according to the third example is an assembly of a general source of UV radiation 11 and a filter. A first filter 11*c* and a second filter 11*d* are provided. The first and the second filters 11*c*, 11*d* may be e.g. optical filters. Each one of the filters 11*c*, 11*d* absorbs part of the radiation emitted by the general source of UV radiation 11 and transmits part of the UV radiation emitted by the general source of UV radiation 11. Part of the beam of radiation, schematically depicted as rays of radiation 20, emitted by the general source of UV radiation 11 passes through the first filter 11*c*, another part of the beam passes through the second filter 11*d*. The part of the beam that passes through the first filter 11*c* provides a first beam of radiation, schematically depicted as rays of radiation 21. The radiation in the first beam of radiation has a first spectrum, the first spectrum having a first main wavelength. The radiation emitted by the general source of radiation 11 not comprised in the first spectrum of the first beam may be absorbed by the first filter 11*c*.

Adjacent to the first filter 11*c*, the second filter 11*d* is provided. The part of the beam emitted by the general source of radiation 11 that passes through the second filter 11*d* provides a second beam of radiation, schematically depicted as rays of radiation 22. The radiation in the second beam of radiation has a second spectrum, the second spectrum having a second main wavelength.

Thus, the first filter 11*c* and the second filter 11*d* may each absorb a part of the radiation emitted by the general source of radiation 11, generating two different beams of radiation, each beam having a main wavelength. The first filter 11*c* is provided upstream in the paper transport direction compared to the second filter 11*d*. Hence, droplets of ink that are applied on the receiving medium 2 and are immobilized, first pass underneath the first filter 11*c* and are thereby irradiated by the first beam of radiation. The first beam of radiation induces pre-curing of the immobilized droplets 16. Afterwards, the pre-cured droplets pass underneath the second filter 11*d* and are then irradiated by the second beam of radiation. The second beam of radiation may induce post-curing of the droplet 16 of ink.

Hence, in the present embodiment the first source of radiation and the second source of radiation are suitably embodied by providing a general source of radiation 11 and a first and a second filter 11*c*, 11*d*.

Figure 5A:
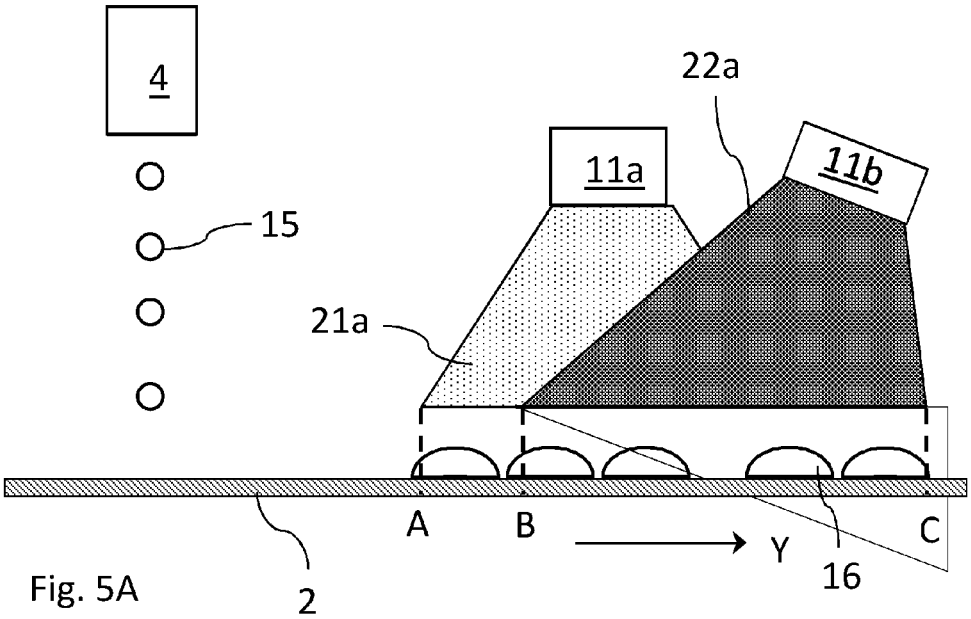
FIGS. 5A and 5B schematically show a fourth example of the method according to the present invention.

FIG. 5A schematically shows a fourth example of the method according to the present invention. A first source of radiation 11*a* is provided, as well as a second source of radiation 11*b*. The first beam of radiation 21*a* emitted by the first source of radiation is divergent; i.e. the diameter of the beam increases with increasing distance from the source of radiation 11*a*. Also the second beam 22*a* emitted by the second source of radiation is divergent. The first beam 21*a* and the second beam 22*a* irradiate the receiving medium and the immobilized droplets 16 deposited thereon. When the immobilized droplets 16 are moved in the paper transport direction, they are first irradiated by the first beam 21*a* at point A. Hence, at point A, pre-curing of the immobilized droplets 16 may start. When the droplets 16 applied on the receiving medium are moved further in the paper transport direction, they are first irradiated by the second beam 22*a* of radiation at point B. Hence, when a droplet 16 of ink passes point B, then post-curing of the droplet may start. The droplet 16 of ink is irradiated by the second beam 22*a* until it passes point C.

For clarity reasons, the first and second beams of radiation 21*a*, 22*a* are depicted at a distance from the receiving medium. However, in practice, the first and second beams 21*a*, 22*a* irradiate the receiving medium 2 and the droplets 16 deposited thereon.

Figure 5B:
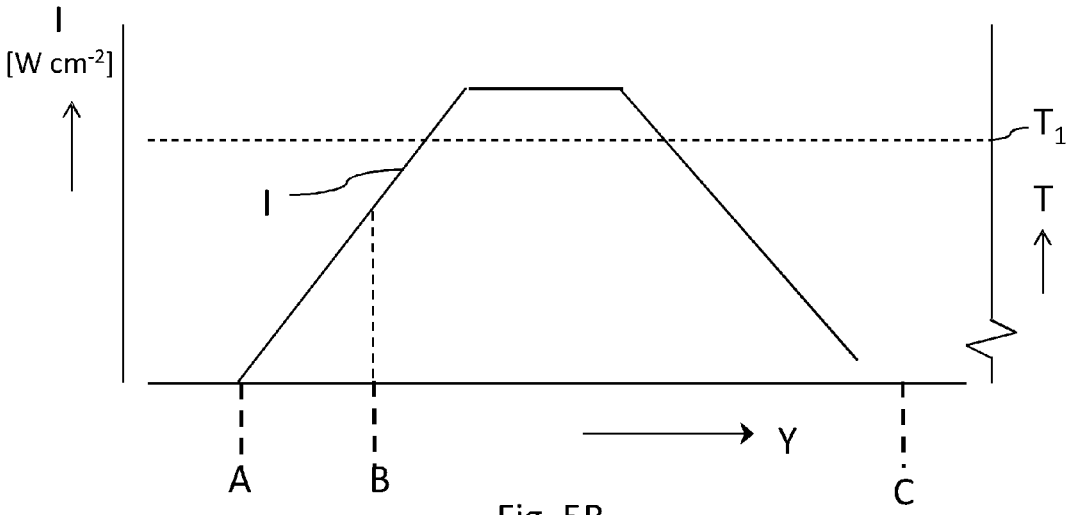

The intensity of the beam at the surface of the receiving medium 2 is not uniform. The intensity of the radiation provided by the first source of radiation 11*a* is strongest right underneath the source of radiation 11*a* and is lower at a position further removed from the source of radiation 11*a*. The intensity I of the first beam of radiation 21*a* at the various positions of the receiving medium is schematically depicted in FIG. 5B. The higher the intensity, the more energy is supplied to the ink. Part of the energy supplied by the first beam 21*a* is applied in the form of heat, which may result in a temperature rise of the droplets of ink 16. In FIG.

5B, also the temperature of the ink at the various positions of the receiving medium 2 is schematically depicted. At point A, the first beam 21*a* first contacts the receiving medium 2. At this point, the intensity I of the first beam 21*a* is essentially 0. Hence, the temperature of the droplets of ink 16 does not increase due to the radiation of the first beam 21*a*. At a position further downstream, the intensity of the radiation of the first beam 21*a* is higher. This may result in increasing rates of pre-curing. In addition, the temperature of the droplets of ink 16 may increase. As is shown in FIG. 5B, at point B the intensity of the radiation emitted by the first source of radiation 11*a* is not such that the temperature of the droplets reaches T1. Hence, at point B, the droplets 16 are still in the immobilized state and are partially cured in the pre-curing step. At point B, the second beam 22*a* starts irradiating the droplets 16 applied onto the receiving medium. The second beam 22*a* as depicted in FIG. 5A is a divergent beam. The second beam 22*a* is emitted by the second source of radiation 11*b*. The radiation of the second beam 22*a* has a second main wavelength and a second intensity. By irradiating the droplets using the second beam of radiation 22*a*, the droplets are post-cured. As explained above, by post-curing the droplets, the droplets 16 of ink may be completely cured and the layer of ink may be hardened. When the ink is hardened, heating of the ink layer above a temperature T1 may not have any influence anymore on the visual appearance, such as the gloss, of the printed image. In a position on the receiving medium 2 downstream of point B, the ink may be irradiated by both the first beam 21*a* and the second beam 22*a* of radiation. Hence, when the droplets of ink 16 are irradiated by the second beam of radiation 22*a*, the ink may be post-cured. When post-curing is being performed, the ink may be heated to a temperature above T1 without negatively influencing the visual appearance of the print.

At a point downstream of point B, the ink may be irradiated by both the first beam of radiation 21*a* and the second beam of radiation 22*a*. When post-curing of the ink has started, the influence of the first beam 21*a* may be relatively small. As is shown in FIG. 5B, the intensity of the first beam of radiation 21*a* irradiating the receiving medium 2 is not constant, but depends on the position on the receiving medium. Locally, the intensity of the first beam of radiation 21*a* is such that the temperature of the ink may locally be higher than T1. However, this is only downstream of position B, i.e. at a position where the post-curing process has already started. Hence, the local high intensity of the first beam of radiation 21*a* does not need to negatively influence the visual appearance of the print, provided the second beam of radiation 22*a* is suitably arranged with regard to the first beam of radiation 21*a*.

The second source of radiation 11*b* as shown in FIG. 5A is in a tilted position. By tilting the source of radiation, the area of the receiving medium 2 irradiated by the beam emitted by the source of radiation can be controlled. The skilled person will understand that the position of the second source of radiation 11*b* can be suitably selected to irradiate a selected area of the receiving medium 2.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually and appropriately detailed structure. In particular, features presented and described in separate dependent claims may be applied in combination and any combination of such claims are herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A method for applying an image onto a receiving medium, the method comprising the steps of:

a) jetting droplets of an ultraviolet curable phase change ink from an ink jet print head at elevated temperature onto the receiving medium, wherein the elevated temperature is a temperature above a phase transition temperature, the phase transition temperature being the temperature below which the ink is in an immobilized state;

b) allowing the deposited droplets of ink to cool to a temperature below the phase transition temperature, the droplets of ink thereby changing from the liquid state into the immobilized state;

c) pre-curing the deposited droplets of ink by irradiating the droplets of ink with a first beam of UV radiation, the first beam having a first intensity; and d) post-curing the deposited ink by irradiating the droplets of ink with a second beam of UV radiation, the second beam having a second intensity, wherein pre-curing is done before post-curing, wherein the intensity of the first beam is controlled such that at least in the pre-curing step, the temperature of the ink does not exceed the phase transition temperature, wherein the second intensity is higher than the first intensity, and wherein the first beam and the second beam overlap.

2. The method according to claim 1, wherein the first beam has a first main wavelength and the second beam has a second main wavelength.

3. The method according to claim 2, wherein the first main wavelength is larger than the second main wavelength.

4. The method according to claim 1, wherein the ink comprises a gellant.

5. The method according to claim 1, wherein the ink comprises a crystalline component, and wherein the phase transition temperature is the melting temperature of the crystalline component.

6. The method according to claim 1, wherein the step a) further comprises the step of moving the print head in reciprocation in a main scanning direction, the main scanning direction being substantially perpendicular to a direction of paper transport.

7. The method according to claim 6 wherein the step c) further comprises the steps of:

providing the first beam of UV radiation by a first source of UV radiation;

providing the second beam of UV radiation by a second source of UV radiation; and moving the first source of UV radiation and the second source of UV radiation in the main scanning direction in a synchronous way.

8. An ink jet printer for applying an image onto a receiving medium, the ink jet printer comprising:

an ink jet print head configured to jet droplets of an ultraviolet curable phase change ink;

a first source of UV radiation, adapted to in operation provide a first beam of UV radiation;

a second source of UV radiation, adapted to in operation provide a second beam of UV radiation;

a transport mechanism configured to move the receiving medium relative to the ink jet print head and the first and second sources of UV radiation in a paper transport direction, and a controller for in operation controlling the intensity of the first beam to have first intensity and controlling the second beam to have a second intensity, wherein the second intensity is higher than the first intensity, wherein the first and second sources of radiation are positioned such that the first and second beams partially overlap.

9. The ink jet printer according to claim 8, wherein the ink jet printer comprises a temperature regulator configured to regulate the temperature of the receiving medium.

* * * * *